United States Patent [19]

Shin

[11] Patent Number: 5,039,460

[45] Date of Patent: Aug. 13, 1991

[54] MIXED HALOCARBON FOR FLASH-SPINNING POLYETHYLENE PLEXIFILAMENTS

[75] Inventor: Hyunkook Shin, Wilmington, Del.

[73] Assignee: E. I. Du Pont de Nemours and Company, Wilmington, Del.

[21] Appl. No.: 484,312

[22] Filed: Feb. 26, 1990

[51] Int. Cl.[5] ..... D01D 5/11

[52] U.S. Cl. ..... 264/13; 264/205; 264/211; 264/211.14

[58] Field of Search ..... 264/205, 53, 13, 211, 264/140, 517, 518, 211.14

[56] References Cited

U.S. PATENT DOCUMENTS

| | | | |
|---|---|---|---|
| 3,081,519 | 3/1963 | Blades | 28/81 |
| 3,227,794 | 1/1966 | Anderson et al. | 264/205 |
| 4,554,207 | 11/1985 | Lee | 428/401 |

OTHER PUBLICATIONS

P. S. Zwer, "Search Intensifier for Alternatives to Ozone-Depleting Halocarbons", *Chemical and Engineering News*, pp. 17-20 (2/8/88).

Fluorocarbon/Ozone Update, "Alternatives to Fully Halogenated Chlorofluorocarbons", The Du Pont Development Program, Du Pont Bulletin E-90566 (Mar. 1987).

*Primary Examiner*—Hubert C. Lorin

[57] ABSTRACT

An improved process is provided for flash-spinning plexifilamentary film-fibril strands of polyethylene. A portion of the conventionally used trichlorofluoromethane ("F-11") is replaced with at least one isomer of dichlorotrifluoroethane to reduce the ozone depletion hazard.

3 Claims, No Drawings

MIXED HALOCARBON FOR FLASH-SPINNING POLYETHYLENE PLEXIFILAMENTS

BACKGROUND OF THE INVENTION

1. Field of the Invention

This invention relates to flash-spinning polymeric film-fibril strands. More particularly, the invention concerns an improvement in such a process which permits flash-spinning of polyethylene strands from a liquid medium which, if released to the atmosphere, Will contain a reduced amount of the trichlorofluoromethane (or "F-11") which has been implicated as a source of depletion of the earth's ozone.

2 Description of the Prior Art

Blades and White, U.S. Pat. No. 3,081,519, describes a flash-spinning process for producing plexifilamentary film-fibril strands from fiber-forming polymers. A solution of the polymer in a liquid, which is a non-solvent for the polymer at or below its normal boiling point, is extruded at a temperature above the normal boiling point of the liquid and at autogenous or higher pressure into a medium of lower temperature and substantially lower pressure. This flash-spinning causes the liquid to vaporize and thereby cool the exudate which forms a plexifilamentary film-fibril strand of the polymer. Preferred polymers include crystalline polyhydrocarbons such as polyethylene and preferred spinning liquids include halocarbons such as F-11

Although F-11 has been a very useful solvent for flash-spinning plexifilamentary film-fibril strands of polyethylene, and has been the solvent used in commercial manufacture of polyethylene plexifilamentary strands, the escape of such a halocarbon into the atmosphere has been implicated as a source of depletion of the earth's ozone. A general discussion of the ozone-depletion problem is presented, for example, by P. S. Zurer, "Search Intensifies for Alternatives to Ozone-Depleting Halocarbons", *Chemical & Engineering News*, pages 17–20 (Feb. 8, 1988).

An object of this invention is to provide a process for flash-spinning plexifilamentary film-fibril strands of fiber-forming polyethylene wherein the solvent contains a reduced amount of F-11 and the process can be operated without major apparatus modifications to a facility which was constructed for flash-spinning from F-11 alone.

SUMMARY OF THE INVENTION

The present invention provides an improved process for flash-spinning plexifilamentary film-fibril strands wherein polyethylene is dissolved in a halocarbon spin liquid to form a spin solution containing 10 to 20 percent of polyethylene by weight of the solution at a temperature in the range of 130 to 210° C. and a pressure that is greater than 1000 psi which solution is flash-spun into a region of substantially lower temperature and pressure, the improvement wherein the halocarbon spin liquid contains about 20 to about 90 weight percent of at least one isomer of dichlorotrifluoroethane, preferably 1,1-dichloro-2,2,2-trifluoroethane, and about 10 to about 90 weight percent trichlorofluoromethane.

In one preferred embodiment of the invention, the halocarbon spin liquid is an azeotrope of about 22 weight percent 1,1-dichloro-2,2,2-trifluoroethane and about 78 weight percent trichlorofluoromethane.

DETAILED DESCRIPTION OF PREFERRED EMBODIMENTS

The term "polyolefin" as used herein, is intended to embrace not only homopolymers of ethylene, but also copolymers wherein at least 85% of the recurring units are ethylene units. One preferred polyethylene is a linear polyethylene which has an upper limit of melting range of about 130 to 135° C., a density in the range of 0.94 to 0.98 g/cm$^3$ and a melt index (as defined by ASTM D-1238-57T, Condition E) of 0.1 to 6.0. However, other polyethylenes having densities as low as 0.92 and melt index values of up to about 100 can also be used.

The term "plexifilamentary film-fibril strands" as used herein, means a strand which is characterized as a three-dimensional integral network of a multitude of thin, ribbon-like, film-fibril elements of random length and of less than about 4 microns average thickness, generally coextensively aligned with the longitudinal axis of the strand. The film-fibril elements intermittently unite and separate at irregular intervals in various places throughout the length, width and thickness of the strand to form the three-dimensional network. Such strands are described in further detail by Blades and White, U.S. Pat. No. 3,081,519 and by Anderson and Romano, U.S. Pat. No. 3,227,794, the disclosures of which are incorporated herein by reference.

The present invention provides an improvement in the known process for producing plexifilamentary film-fibril strands of fiber-forming polyethylene from a halocarbon spin liquid that contains 10 to 20 weight percent of the fiber-forming polyethylene. A fiber-forming polyethylene is dissolved in the spin liquid to form a spin solution containing 10 to 20 percent of the linear polyethylene by weight of the solution and then is flash-spun at a temperature in the range of 130 to 210° C. and a pressure that is greater than the autogenous pressure of the spin liquid into a region of substantially lower temperature and pressure.

The key improvement of the present invention involves the replacement of a portion of the conventionally used F-11 with at least one isomer of dichlorotrifluoroethane, preferably 1,1-dichloro-2,2,2-trifluoroethane ("HC-123"). The other two isomers are 1,2-dichloro-1,2,2-trifluoroethane ("HC-123a") and 1,1-dichloro-1,2,2-trifluoroethane ("HC-123b").

The following table lists the known normal atmospheric boiling points (Tbp), critical temperatures (Tcr) and critical pressures (Pcr) for the individual halocarbons and for some prior art solvents.

| | Tbp, °C. | Tcr, °C. | Pcr, psia |
|---|---|---|---|
| HC-123 | 28.7 | 185 | 550 |
| HC-123a | 28 | | |
| HC-123b | 30.2 | | |
| Trichloro-fluoromethane | 23.8 | 198.0 | 639.5 |
| Methylene-chloride | 39.9 | 237.0 | 894.7 |
| Hexane | 68.9 | 234.4 | 436.5 |
| Cyclohexane | 80.7 | 280.4 | 590.2 |

The HC-123 and its isomers appear to have only a minimal effect upon ozone in the earth's atmosphere. Also it does not appear to suffer from undue toxicity characteristics and it is stable under a wide variety of processing conditions. By replacing a portion of the conventionally used F-11 with HC-123 or its isomers, it is possible to operate a commercial flash-spinning facility without substantial modification and in such a way that when any traces of spin liquid escape to the atmosphere, they will contain a reduced proportion of the F-11 constituent.

A very convenient composition of HC-123 and F-11 is one composed of about 22 and 78 weight percent, respectively, as this is an azeotrope which is easily used and conveniently recovered as such for recycling. However, increasing amounts of the HC-123 or its isomers can also be used, and indeed it is preferred to replace as much of the F-11 as is possible.

The concentration of fiber-forming polyethylene in the spin liquid usually is in the range of 10–20 percent, based on the total weight of the liquid and the fiber-forming polyethylene.

The spin solution preferably consists of halocarbon liquid and fiber-forming polyethylene, but conventional flash-spinning additives can be incorporated by known techniques. These additives can function as ultraviolet-light stabilizers, antioxidants, fillers, dyes, and the like.

The various characteristics and properties mentioned in the preceding discussion and in the examples below were determined by the following procedures.

TEST METHODS

The quality of the plexifilamentary film-fibril strands produced in the examples were rated subjectively. A rating of "5" indicates that the strand had better fibrillation than is usually achieved in the commercial production of spunbonded sheet made from such flash-spun polyethylene strands. A rating of 4"indicates that the product was as good as commercially flash-spun strands. A rating of "3" indicates that the strands were not quite as good as the commercially flash-spun strands. A "2"indicates a very poorly fibrillated, inadequate strand. A "1" indicates no strand formation. A rating of "3" is the minimum considered satisfactory for use in the process of the present invention. The commercial strand product is produced from solutions of about 12.5% linear polyethylene in tichlorofluoromethane substantially as set forth in Lee, U.S. Pat. No. 4,554,207, column 4, line 63, through column 5, line 10, which disclosure is hereby incorporated by reference.

The surface area of the plexifilamentary film-fibril strand product is another measure of the degree and fineness of fibrillation of the flash-spun product. Surface area is measured by the BET nitrogen absorption method of S. Brunauer, P. H. Emmett and E. Teller, J. Am. Chem Soc., V. 60 p 309–319 (1938) and is reported as $m^2/g$.

Tenacity of the flash-spun strand is determined with an Instron tensile testing machine. The strands are conditioned and tested at 70° F. and 65% relative humidity.

The denier of the strand is determined from the weight of a 15 cm sample length of strand. The sample is then twisted to 10 turns per inch and mounted in the jaws of the Instron Tester. A 1-inch gauge length and an elongation rate of 60% per minute are used. The tenacity at break is recorded in grams per denier (gpd).

The invention is illustrated in the Examples which follow with a batch process in equipment of relatively small size. Such batch processes can be scaled-up and converted to continuous flash-spinning processes that can be performed, for example, in the type of equipment disclosed by Anderson and Romano, U.S. Pat. No. 3,227,794. Parts and percentages are by weight unless otherwise indicated.

EXAMPLES

For each of of the Examples, a high density linear polyethylene of 0.76 Melt Index was flash-spun into satisfactory plexifilamentary film-fibril strand in accordance with the invention.

The apparatus used consists of two high pressure cylindrical chambers, each equipped with a piston which is adapted to apply pressure to the contents of the vessel. The cylinders have an inside diameter of 1.0 inch ($2.54\times10^{-2}$m) and each has an internal capacity of 50 cubic centimeters. The cylinders are connected to each other at one end through a 3/32 inch ($2.3\times10^{-3}$m) diameter channel and a mixing chamber containing a series of fine mesh screens is used as a static mixer. Mixing it accomplished by forcing the contents of the vessel back and forth between the two cylinders through the static mixer. A spinneret assembly with a quick-acting means for opening the orifice then attached to the channel through a tee. The spinneret assembly consists of a pressure letdown orifice of 0.03375 inch ($8.5\times10^{-4}$m) diameter and 0.030 inch length ($7.62\times10^{-4}$m), a letdown chamber of 0.25 inch ($6.3\times10^{-3}$m) diameter and 1.92 inch length, and a spinneret orifice of 0.030 inch ($7.62\times10^{-4}$m) diameter and either 0.020 or 0.030 inches in length. The pistons are driven by high pressure water supplied by a hydraulic system. Pressure transducers are used to measure the pressure before and after the letdown orifice.

In operation, the apparatus is charged with polyethylene pellets and solvents, and high pressure water, e.g. 1800 psi (12410 kPa) is introduced to drive the piston to compress the charge. The contents then are heated to mixing temperature and held at that temperature for about an hour or longer during which time a differential pressure of about 50 psi (345 kPa) is alternatively established between the two cylinders to repeatedly force the contents through the mixing channel from on cylinder to the other to provide mixing and effect formation of a solution. The solution temperature is then raised to the final spin temperature, and held there for about 15 minutes to equilibrate the temperature. Mixing is continued throughout this period. Finally, the spinneret orifice is opened, and the resultant flash-spun product is collected. The pressure inside the letdown chamber recorded during spinning using a computer is entered as spin pressure. For Examples I, II, and III, the letdown chamber was omitted, the pressure was reduced manually to the desired spinning pressure, and the pressure measured just before the spinneret during spinning was entered as the spin pressure.

TABLE

| Example No. | I | II | III | IV | V |
|---|---|---|---|---|---|
| Solvent Composition | | | | | |
| HC-123, % | 50 | 66.7 | 85 | 50 | 22 |
| F-11, % | 50 | 33.3 | 15 | 50 | 78 |
| Mixing | | | | | |
| Temp., °C. | 140 | 140 | 140 | 170 | 150 |
| Press., psig | 2800 | 2800 | 5500 | 2000 | 1800 |
| Spinning | | | | | |
| Temp., °C. | 170 | 170 | 160 | 170 | 170 |
| Press., psig | 2900 | 2900 | ~5000 | 1200 | ~900 |
| Spinneret, | | | | | |
| DxL, in. | 0.030 × 0.020 | 0.030 × 0.020 | 0.030 × 0.030 | 0.030 × 0.030 | 0.030 × 0.030 |

TABLE-continued

| Example No. | I | II | III | IV | V |
|---|---|---|---|---|---|
| Strand Product | | | | | |
| Denier | — | — | 639 | 378 | 396 |
| Tenacity, gpd | — | — | 2.7 | 2.46 | 2.52 |
| Quality | 5 | 4 | 4.5 | 4.5 | 5 |
| Surface Area, $m^2/g$ | — | — | 79.2 | — | — |

I Claim:

1. A process for flash-spinning plexifilamentary film-fibril strands wherein polyethylene is dissolved in a halocarbon spin liquid to form a spin solution containing 10 to 20 percent of polyethylene by weight of the solution at a temperature in the range of 130 to 210° C and a pressure that is greater than about 1000 psi, which solution is flash-spun into a region of substantially lower temperature and pressure, the improvement wherein the halocarbon spin liquid contains about 20 to about 90 weight percent of at least one isomer of dichlorotrifluoroethane and about 10 to about 80 weight percent trichlorofluoromethane.

2. A process according to claim 1 wherein the isomer is 1,1-dichloro-2,2,2-trifluoroethane.

3. A process for flash-spinning plexifilamentary film-fibril strands according to claim 1 wherein the halocarbon spin liquid is an azeotrope of about 22 weight percent 1,1-dichloro-2,2,2-trifluoroethane and about 78 weight percent trichlorofluoromethane.

* * * * *